US009153865B2

(12) United States Patent
Ishizuka et al.

(10) Patent No.: US 9,153,865 B2
(45) Date of Patent: Oct. 6, 2015

(54) ANTENNA DEVICE AND COMMUNICATION TERMINAL APPARATUS

(71) Applicant: Murata Manufacturing Co., Ltd., Nagaokakyo-shi, Kyoto-fu (JP)

(72) Inventors: Kenichi Ishizuka, Nagaokakyo (JP); Hiroshi Nishida, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/247,271

(22) Filed: Apr. 8, 2014

(65) Prior Publication Data

US 2014/0218246 A1 Aug. 7, 2014

Related U.S. Application Data

(63) Continuation of application No. PCT/JP2013/072673, filed on Aug. 26, 2013.

(30) Foreign Application Priority Data

Aug. 28, 2012 (JP) ..... 2012-187238

(51) Int. Cl.
*H01Q 1/50* (2006.01)
*H01Q 7/00* (2006.01)
(Continued)

(52) U.S. Cl.
CPC ..... *H01Q 1/50* (2013.01); *H01Q 1/243* (2013.01); *H01Q 5/335* (2015.01); *H01Q 5/357* (2015.01); *H01Q 7/00* (2013.01); *H01Q 9/26* (2013.01)

(58) Field of Classification Search
CPC ..... H01Q 1/50
USPC ..... 343/749
See application file for complete search history.

(56) References Cited

U.S. PATENT DOCUMENTS 2,320,124 A * 5/1943 Forbes ..... 455/193.2
2002/0018021 A1 2/2002 Koyanagi et al.
(Continued)

FOREIGN PATENT DOCUMENTS

EP 1 146 590 A2 10/2001
EP 2 388 858 A1 11/2011
(Continued)

OTHER PUBLICATIONS

Official Communication issued in International Patent Application No. PCT/JP2013/072673, mailed on Oct. 22, 2013.
(Continued)

*Primary Examiner* — Dameon E Levi
*Assistant Examiner* — Andrea Lindgren Baltzell
(74) *Attorney, Agent, or Firm* — Keating & Bennett, LLP

(57) ABSTRACT

A multiband-capable antenna device includes a loop-shaped radiation element including a power feed end and a ground end, and a matching circuit including a first inductance element loaded at the power feed end and a second inductance element loaded at the ground end and magnetic-field coupled to the first inductance element. The loop-shaped radiation element is configured to resonate in a plurality of resonance modes including an even mode and an odd mode. The first inductance element and the second inductance element are wound and connected such that magnetic fields are mutually strengthened for one of the even mode and the odd mode, and such that the magnetic fields are mutually weakened for the other of the even mode and the odd mode.

14 Claims, 8 Drawing Sheets

(51) Int. Cl.

| | |
|---|---|
| ***H01Q 9/26*** | (2006.01) |
| ***H01Q 1/24*** | (2006.01) |
| ***H01Q 5/335*** | (2015.01) |
| ***H01Q 5/357*** | (2015.01) |

(56) References Cited

U.S. PATENT DOCUMENTS

| | | | | |
|---|---|---|---|---|
| 2008/0197710 | A1* | 8/2008 | Kreitz et al. | 307/104 |
| 2011/0105072 | A1* | 5/2011 | Bhagat et al. | 455/323 |
| 2011/0273361 | A1 | 11/2011 | Autti | |
| 2012/0001701 | A1 | 1/2012 | Taniguchi et al. | |
| 2013/0249767 | A1 | 9/2013 | Ishizuka et al. | |
| 2014/0049440 | A1 | 2/2014 | Ueki et al. | |

FOREIGN PATENT DOCUMENTS

| | | | |
|---|---|---|---|
| JP | 2002-043826 | A | 2/2002 |
| JP | 2003-051705 | A | 2/2003 |
| JP | 2009-206975 | A | 9/2009 |
| JP | 2013-207438 | A | 10/2013 |
| WO | 2010/104179 | A1 | 9/2010 |
| WO | 2012/099085 | A1 | 7/2012 |
| WO | 2012/153690 | A1 | 11/2012 |

OTHER PUBLICATIONS

Official Communication issued in corresponding European Patent Application No. 13831926.4, mailed on Jan. 28, 2015.

* cited by examiner

ANTENNA DEVICE AND COMMUNICATION TERMINAL APPARATUS

BACKGROUND OF THE INVENTION

1. Field of the Invention

The present invention relates to an antenna device capable of transmitting and receiving radio signals in a plurality of frequency bands, and a communication terminal apparatus including such an antenna device.

2. Description of the Related Art

In a communication terminal apparatus including a mobile phone, for example, such a loop antenna as disclosed in Japanese Patent Laying-Open No. 2002-43826 may be utilized. This loop antenna is configured by a looped-shaped conductor having one end as a power feed end and the other end as a ground end, and having an entire length of one wavelength. This loop antenna suppresses gain reduction even when being used in proximity to a human body, and exhibits excellent radiation characteristics.

In recent years, there is a need for a communication terminal apparatus to accommodate a plurality of frequency bands. For example, a communication terminal apparatus accommodating a penta-band of GSM (registered trademark; Global System for Mobile communication) 850, GSM900, GSM1800, GSM1900, and UMTS (Universal Mobile Telecommunications System) is required to accommodate a relatively wider band of 824 to 960 MHz (Low Band) and 1710 to 2170 MHz (High Band).

According to the loop antenna for accommodating such a relatively wider band, as shown in FIG. 1A, three resonances (resonance 1, resonance 2 and resonance 3) are used to cover a plurality of frequency bands. In other words, resonance 1 forms a passband in a Low Band while resonance 2 and resonance 3 form a band in a High Band.

As shown in FIG. 1B, resonance 1 is caused by fundamental waves in the odd mode, and shows a resonance mode having monopole-type current distribution in which the intermediate point of loop antenna 101 is defined as an electric field maximum point. Resonance 2 occurs in the even mode, and shows a resonance mode having dipole-type current distribution in which there are two electric field maximum points on loop antenna 101. Resonance 3 is caused by harmonics in the odd mode, and shows a resonance mode having current distribution as shown in the figure in which there are three electric field maximum points on loop antenna 101. In this case, the "odd mode" represents a mode in the state where the current direction from the power feed end to the radiation element and the current direction from the ground end to the radiation element are aligned with each other. The "even mode" represents a mode in the state where the current direction from the power feed end to the radiation element and the current direction from the ground end to the radiation element are opposite to each other.

The resonance frequency of each resonance can be determined by the size of loop antenna 101. On the other hand, when this resonance frequency is controlled in a matching circuit, it is conceivable to implement a configuration in which an inductance element L1 and an inductance element L2 are loaded at the power feed end and the ground end, respectively, of the antenna, as shown in FIG. 1C.

However, when inductance elements are loaded in this way to adjust the frequency, the amount of change in each resonance frequency is increased as the frequency is higher. In other words, by the method of simply loading an inductance element, it is difficult to independently control the resonance frequency for each resonance mode.

SUMMARY OF THE INVENTION

Preferred embodiments of the present invention provide a multiband-capable antenna device exhibiting excellent frequency characteristics, by which a resonance frequency in each resonance mode is independently controlled in an antenna element having a plurality of resonance modes, and provide a communication terminal apparatus including such an antenna device.

According to a preferred embodiment of the present invention, an antenna device includes a radiation element including a first conductor including a power feed end and a ground end; and a matching circuit including a first inductance element loaded at the power feed end of the first conductor, and a second inductance element loaded at the ground end of the second conductor and magnetic-field coupled to the first inductance element. The radiation element is configured to resonate in a plurality of resonance modes including an even mode and an odd mode. The first inductance element and the second inductance element are wound and connected such that magnetic fields are mutually strengthened for one of the even mode and the odd mode, and such that the magnetic fields are mutually weakened for the other of the even mode and the odd mode.

Furthermore, a communication terminal apparatus according to another preferred embodiment of the present invention includes a power feed element; a radiation element including a power feed end and a ground end; and a matching circuit including a first inductance element loaded at the power feed end of the first conductor, and a second inductance element loaded at the ground end of the second conductor and magnetic-field coupled to the first inductance element. The radiation element is configured to resonate in a plurality of resonance modes including an even mode and an odd mode. The first inductance element and the second inductance element are wound and connected such that magnetic fields are mutually strengthened for one of the even mode and the odd mode, and such that the magnetic fields are mutually weakened for the other of the even mode and the odd mode.

According to various preferred embodiments of the present invention, since resonance frequencies in a plurality of resonance modes in a radiation element are controlled independently, a multiband-capable antenna device exhibiting excellent frequency characteristics is provided. Furthermore, a multiband-capable communication terminal apparatus exhibiting excellent frequency characteristics including such an antenna device is provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

An antenna device and a communication terminal apparatus of the present invention will be hereinafter described based on the first to third preferred embodiments.

First Preferred Embodiment

An antenna device according to the present preferred embodiment preferably uses 824 MHz to 960 MHz (Low Band) and 1710 MHz to 2170 MHz (High Band) as a passband, and accommodates a penta-band of GSM850, GSM900, GSM1800, GSM1900, and UMTS, for example.

Figure 1A:
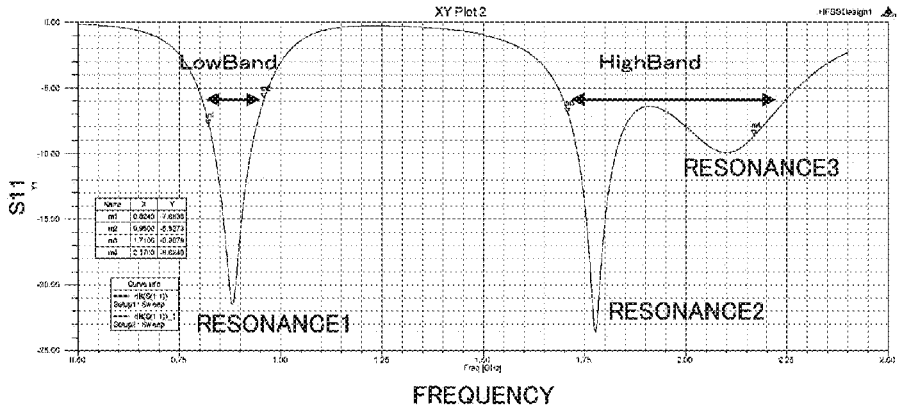
FIG. 1A PRIOR ART
FIG. 1A is a graph showing frequency characteristics of a loop antenna.
Figure 1B:
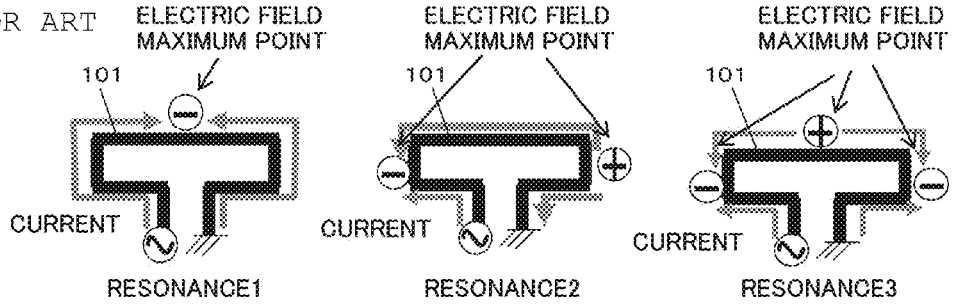
FIG. 1B PRIOR ART
FIG. 1B is a schematic diagram illustrating an operation principle in each resonance mode.
Figure 1C:
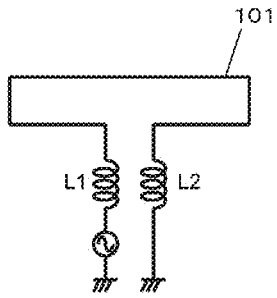
FIG. 1C PRIOR ART
FIG. 1C is an equivalent circuit diagram of an antenna device including an inductance element loaded in a loop antenna.
Figure 2:
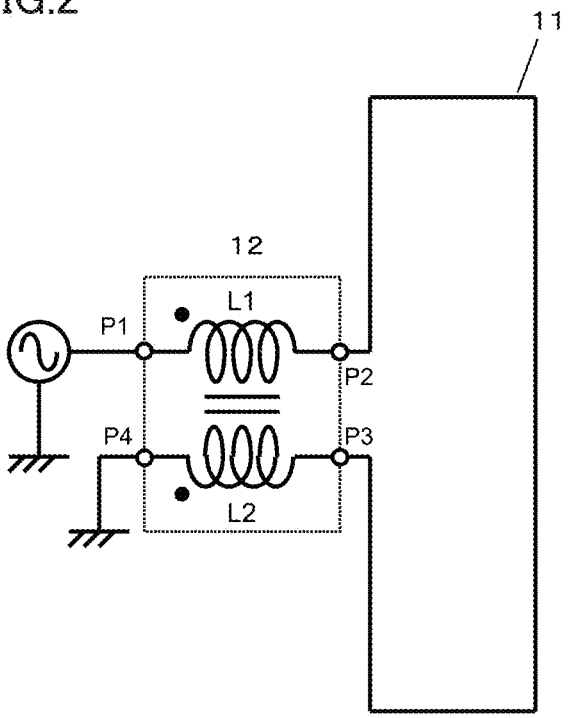
FIG. 2 is an equivalent circuit diagram of an antenna device according to a first preferred embodiment of the present invention.

This antenna device utilizes a loop-shaped radiation element 11 preferably having an electric length of one wavelength as a radiation element, as shown in FIG. 2. Loop-shaped radiation element 11 includes one end (terminal P2) that is a power feed end connected to a power feed element, and the other end (terminal P3) that is a ground end connected to the ground. This loop-shaped radiation element 11 is shaped such that the first conductor including one end defining a power feed end and the second conductor including one end defining a ground end are connected at their respective other ends, and constitute a folded dipole antenna. This loop-shaped radiation element has a plurality of resonance modes, which will be described later in detail.

A first inductance element L1 and a second inductance element L2 are loaded at the power feed end and the ground end, respectively, of loop-shaped radiation element 11. In other words, the first inductance element includes one end (terminal P1) that is connected to the power feed element, and another end (terminal P2) connected to one end (the power feed end) of loop-shaped radiation element 11. The second inductance element has one end (terminal P4) connected to ground, and another end (terminal P3) connected to another end (the ground end) of loop-shaped radiation element 11. First inductance element L1 and second inductance element L2 are coupled (additive polarity coupled) to each other through the magnetic field, and define a matching circuit (a matching circuit element 12).

Figure 3:
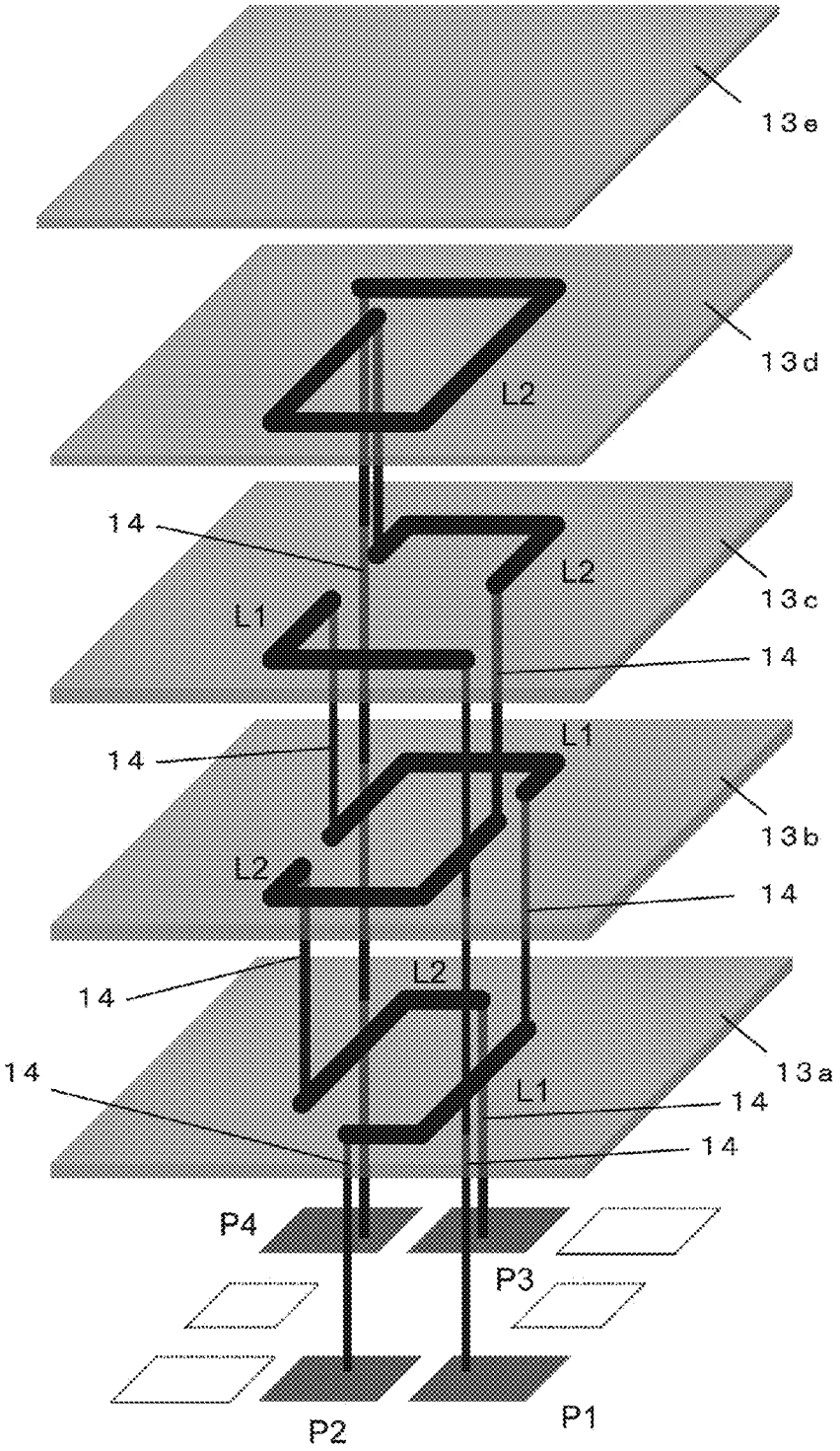
FIG. 3 is an exploded view of a matching circuit element in the antenna device according to the first preferred embodiment.

As shown in FIG. 3, the matching circuit including inductance element L1 and inductance element L2 is preferably configured as a chip component (matching circuit element 12) using a stacked body as an element body that is obtained by stacking a plurality of base material layers 13*a*, 13*b*, 13*c*, 13*d*, and 13*e*, for example. In other words, each set of inductance element L1 and inductance element L2 preferably is formed integrally with the stacked body formed by stacking base material layers 13*a*, 13*b*, 13*c*, 13*d*, and 13*e*. The stacked body includes a back surface on which eight terminals are provided, including four terminals P1 to P4 each defining and serving as an input/output terminal connected to a corresponding inductance element, and other four terminals each defining and serving as an NC (non-contact) terminal.

In this stacked body, terminal P1 is connected through a via-hole conductor 14 provided in base material layer 13*a*, via-hole conductor 14 provided in base material layer 13*b* and via-hole conductor 14 provided in base material layer 13*c* to one end of the conductor pattern having a half-turn coil shape and provided in base material layer 13*c*. The other end of this conductor pattern is connected through via-hole conductor 14 provided in base material layer 13*c* to one end of the conductor pattern having a half-turn coil shape and provided in base material layer 13*b*. The other end of this conductor pattern is connected through via-hole conductor 14 provided in base material layer 13*b* to one end of the conductor pattern having a half-turn coil shape and provided in base material layer 13*a*. The other end of this conductor pattern is connected through via-hole conductor provided in base material layer 13*a* to terminal P2 provided on the back surface of the stacked body. First inductance element L1 is defined by these conductor patterns and via-hole conductors.

Similarly, terminal P4 is connected through via-hole conductor 14 provided in base material layer 13*a*, via-hole conductor 14 provided in base material layer 13*b*, via-hole conductor 14 provided in base material layer 13*c*, and via-hole conductor 14 provided in base material layer 13*d* to one end of the conductor pattern having a one-turn coil shape and provided in base material layer 13*d*. The other end of this conductor pattern is connected through via-hole conductor 14 provided in base material layer 13*d* to one end of the conductor pattern having a half-turn coil shape and provided in base material layer 13*c*. The other end of this conductor pattern is connected through via-hole conductor 14 provided in base material layer 13*c* to one end of the conductor pattern having a half-turn coil shape and provided in base material layer 13*b*. The other end of this conductor pattern is connected through via-hole conductor 14 provided in base material layer 13*b* to one end of the conductor pattern having a half-turn coil shape and provided in base material layer 13*a*. The other end of this conductor pattern is connected through via-hole conductor provided in base material layer 13*a* to terminal P3 provided on the back surface of the stacked body. Second inductance element L2 is defined by these conductor patterns and via-hole conductors 14.

Each of base material layers 13*a* to 13*e* may be a ceramic layer like an LTCC ceramic layer, or may be a resin layer like a thermoplastic resin or a thermosetting resin, for example. In other words, the stacked body may be a ceramic stacked body or may be a resin stacked body. An in-plane conductor and an interlayer connection conductor (via-hole conductor) provided in each of base material layers 13*a* to 13*e* are preferably made of a metal material including silver, copper or the like as a main component and having a relatively low specific resistance, for example.

The communication terminal apparatus according to the present preferred embodiment preferably is a mobile phone accommodating a penta-band of GSM850, GSM900, GSM1800, GSM1900, and UMTS, for example.

Figure 4A:
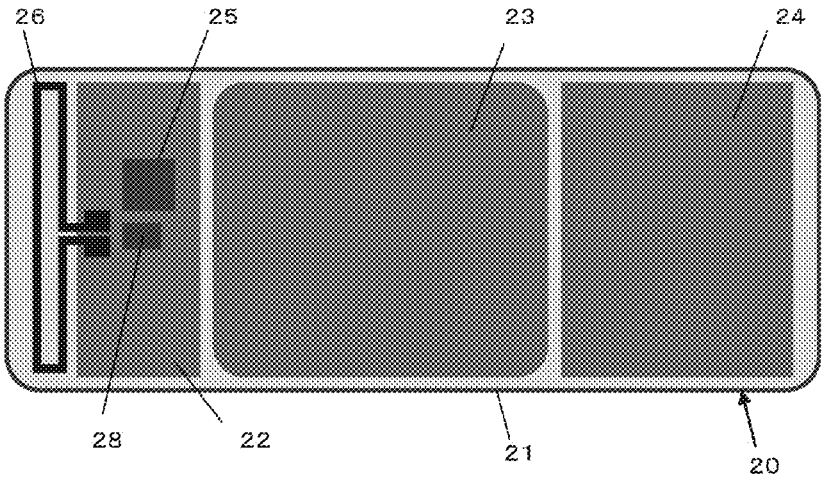
FIG. 4A is a schematic plan view and FIG. 4B is a schematic cross-sectional view of a communication terminal apparatus according to the first preferred embodiment of the present invention.
Figure 4B:
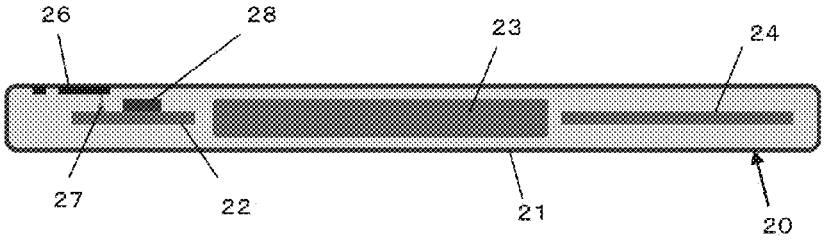

The communication terminal apparatus 20 includes a terminal housing 21 having a rectangular or substantially rectangular outer shape, as shown in FIG. 4. The terminal housing 21 preferably includes a first printed wiring board 22, a battery pack 23, a second printed wiring board 24, a liquid crystal display element (not shown), and the like. Each of first printed wiring board 22 and second printed wiring board 24 is provided with a ground (not shown) having an area that is equal or approximately equal to those of their main surfaces. On the surface of each ground, various types of functional circuit components such as a drive circuit of a display element, a control circuit of a power supply and an IC chip 25 for cellular communication are mounted. Loop-shaped radiation element 26 is provided by affixing a sheet of a flexible base material having a loop pattern located thereon onto the inner wall surface near the end of terminal housing 21. Loop-shaped radiation element 26 has one end connected to matching circuit element 28 mounted on first printed wiring board 22 via a contact pin 27 provided on first printed wiring board 22, and also has the other end connected similarly to matching circuit element 28 similarly via contact pin 27 provided on first printed wiring board 22. The power feed-side terminal (terminal P1) of matching circuit element 28 is connected to IC chip 25 for cellular communication mounted on first printed wiring board 22 while the ground-side terminal (terminal P4) of matching circuit element 28 is connected to the ground of first printed wiring board 22.

Figure 5:
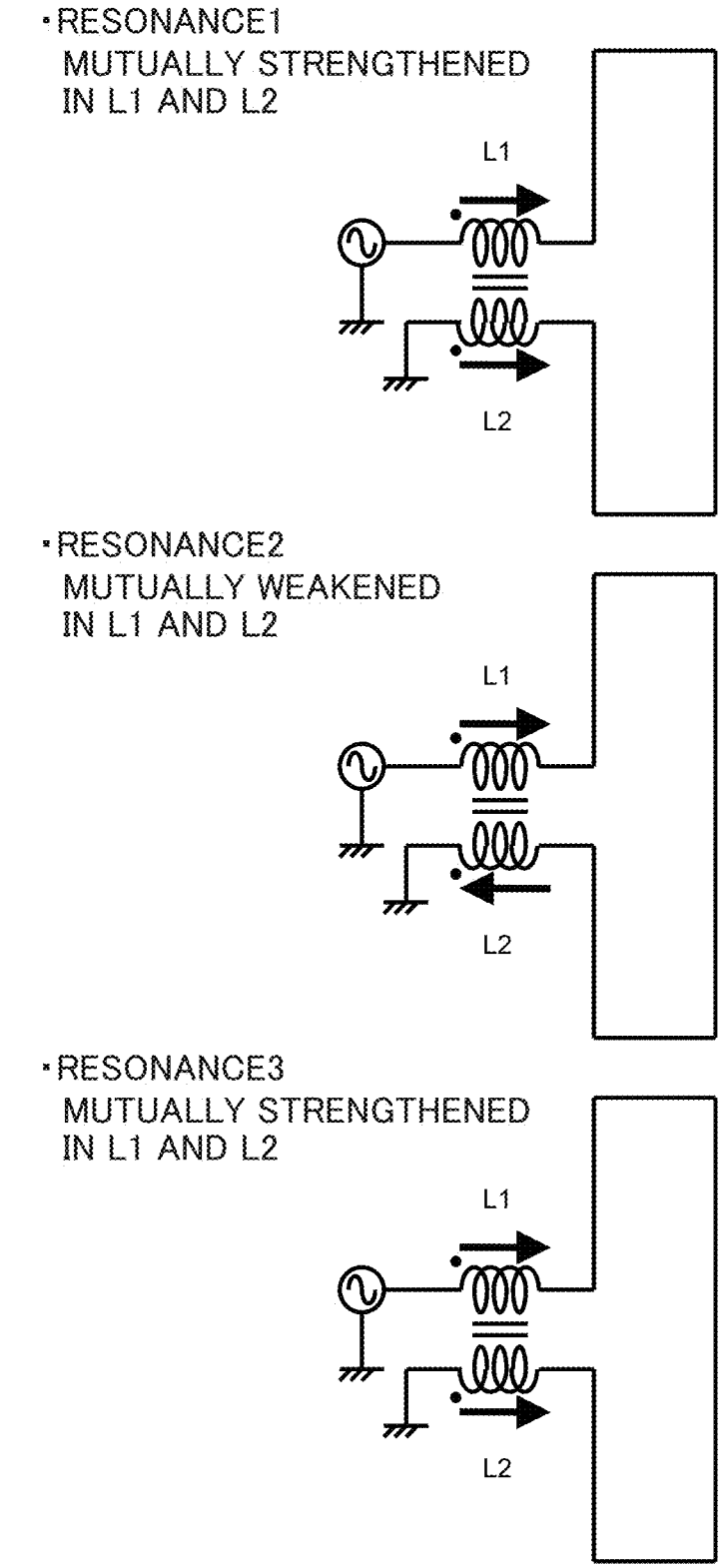
FIG. 5 is a schematic diagram illustrating an operation principle of the antenna device according to the first preferred embodiment of the present invention.
Figure 6:
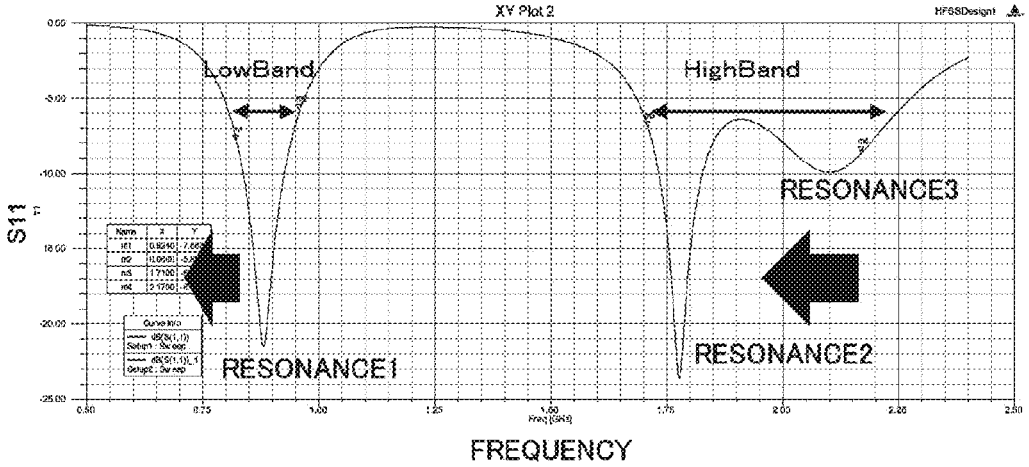
FIG. 6 is a graph showing frequency characteristics of the antenna device according to the first preferred embodiment of the present invention.

Loop-shaped antenna element 26 according to the present preferred embodiment includes three resonance modes including the first resonance mode (resonance 1), the second resonance mode (resonance 2) and the third resonance mode (resonance 3) in increasing order of a resonance frequency. The first resonance mode and the third resonance mode each are an odd mode while the second resonance mode is an even mode. As shown in FIGS. 5 and 6, resonance 1 is caused by fundamental waves in the odd mode, and shows a resonance mode having monopole-type current distribution in which the intermediate point of the loop antenna is defined as an electric field maximum point. Resonance 1 has a resonance frequency in the Low Band. Resonance 2 occurs in the even mode, and shows a resonance mode having dipole-type current distribution in which there are two electric field maximum points on the loop antenna. This resonance 2 exhibits resonance on the low-frequency side in the High Band. Resonance 3 is caused by harmonics in the odd mode, and shows a resonance mode having current distribution as shown in the figure, in which there are three electric field maximum points on the loop antenna. This resonance 3 exhibits resonance on the high-frequency side in the High Band.

As described above, the "odd mode" is a mode in the state where the current direction from the power feed end to the radiation element and the current direction from the ground end to the radiation element are aligned with each other, and is a transmission mode where inductance element L1 and inductance element L2 have voltages having different polarities. The "even mode" is a mode in the state where the current direction from the power feed end to the radiation element and the current direction from the ground end to the radiation element are opposite to each other, and is a transmission mode where inductance element L1 and inductance element L2 have voltages having the same polarity.

In the present preferred embodiment, inductance element L1 and inductance element L2 are wound and connected such that the magnetic fields are mutually strengthened for the odd mode, and that the magnetic fields are mutually weakened for the even mode. Therefore, as shown in FIG. 5, for resonance 1 and resonance 3, inductance element L1 and inductance element L2 each act as an inductance element having a large L value since their magnetic fields are mutually strengthened. On the other hand, for resonance 2, the magnetic fields generated in inductance element L1 and inductance element L2 are mutually weakened. More specifically, the magnetic field generated in each inductance element is cancelled. Therefore, according to the configuration of the present preferred embodiment, as shown in FIG. 6, only the resonance frequencies of resonance 1 and resonance 3 can be selectively shifted to the low-pass side without greatly shifting the resonance frequency of the resonance 2 (more strictly, the frequency of resonance 3 is shifted more than the frequency of resonance 1).

Second Preferred Embodiment

Figure 7:
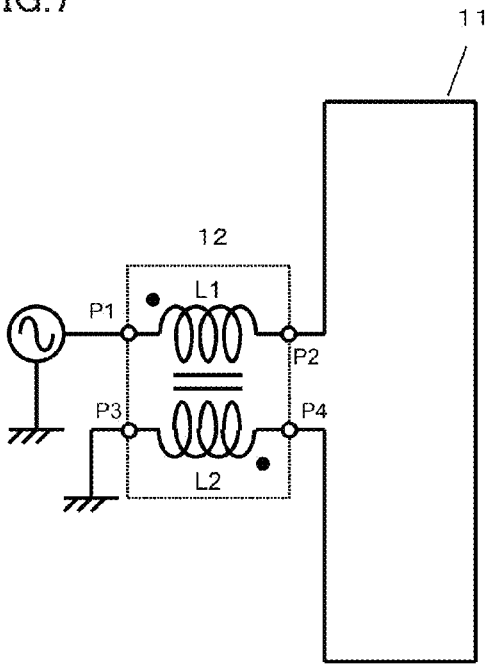
FIG. 7 is an equivalent circuit diagram of an antenna device according to a second preferred embodiment of the present invention.
Figure 8:
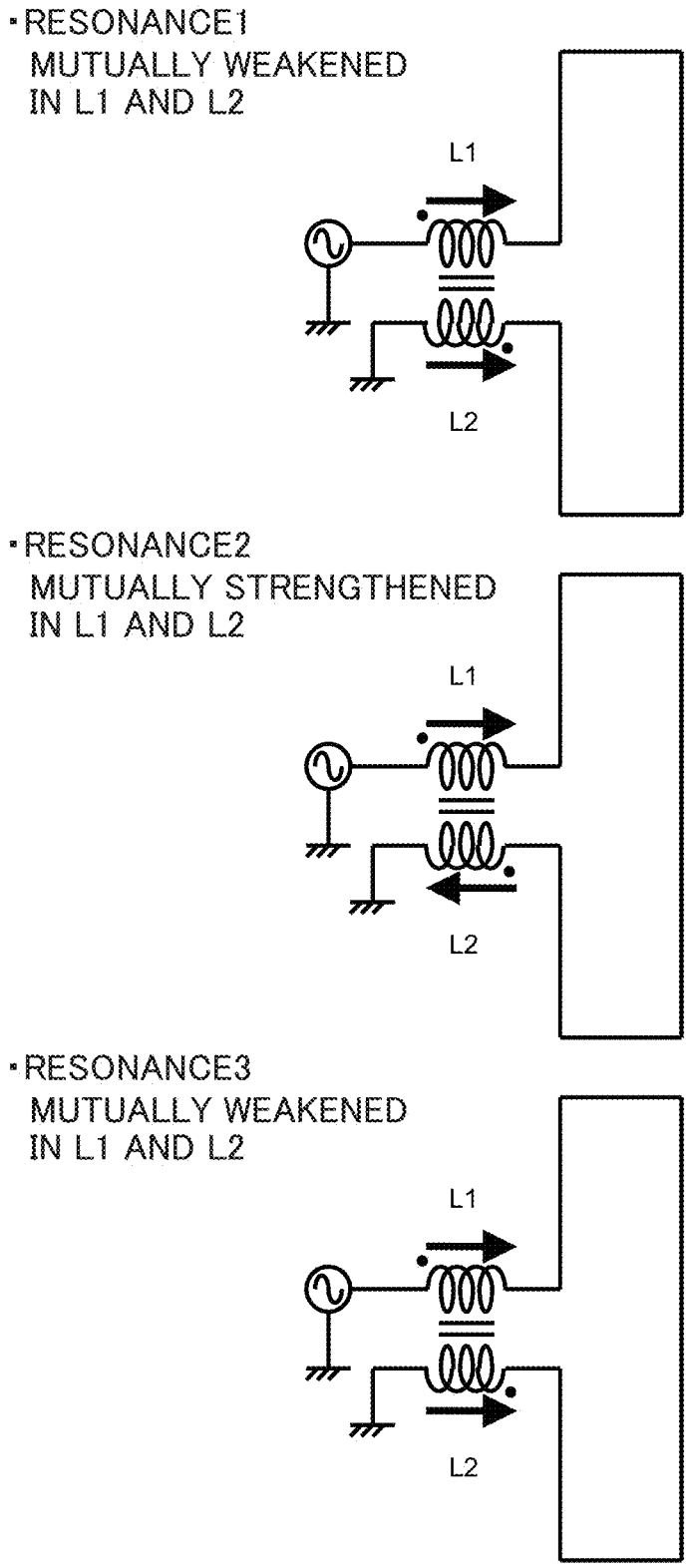
FIG. 8 is a schematic diagram illustrating the operation principle of the antenna device according the second preferred embodiment of the present invention.
Figure 9:
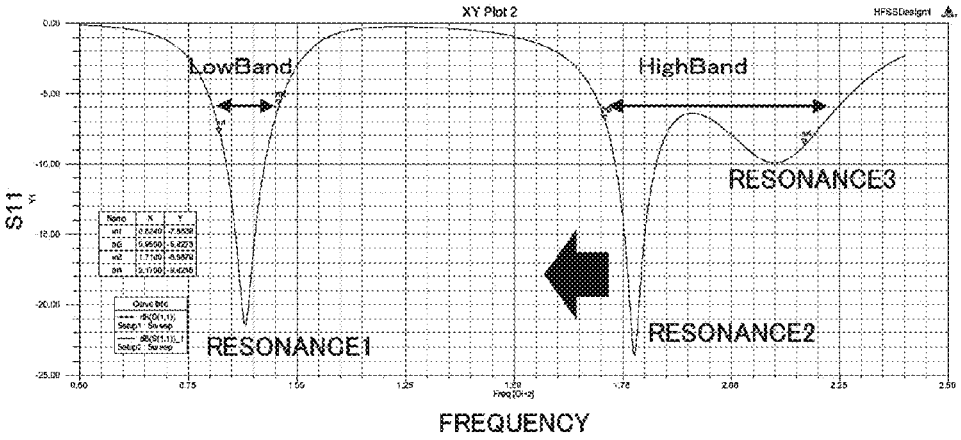
FIG. 9 is a graph showing frequency characteristics of the antenna device according to the second preferred embodiment of the present invention.

Although the antenna device according to the present preferred embodiment preferably has a configuration basically similar to that of the antenna device according to the first preferred embodiment, first inductance element L1 and second inductance element L2 are coupled (subtractive polarity coupled) through the magnetic field, as shown in FIG. 7. Specifically, the power feed end of loop-shaped radiation element 11 is connected to terminal P2 of matching circuit element 12, and the ground end of loop-shaped radiation element 11 is connected to terminal P4 of matching circuit element 12. In other words, inductance element L1 and inductance element L2 are wound and connected such that the magnetic fields are mutually weakened for the odd mode, and such that the magnetic fields are mutually strengthened for the even mode. Therefore, as shown in FIG. 8, for resonance 1 and resonance 3, the magnetic fields are mutually weakened in inductance element L1 and inductance element L2, and the magnetic fields generated in inductance element L1 and inductance element L2 are canceled. On the other hand, for resonance 2, the magnetic fields generated in inductance element L1 and inductance element L2 are mutually strengthened. Therefore, as shown in FIG. 9, only the resonance frequency of resonance 2 can be selectively shifted to the low-pass side without greatly shifting the resonance frequencies of resonance 1 and resonance 3.

Third Preferred Embodiment

Figure 10:
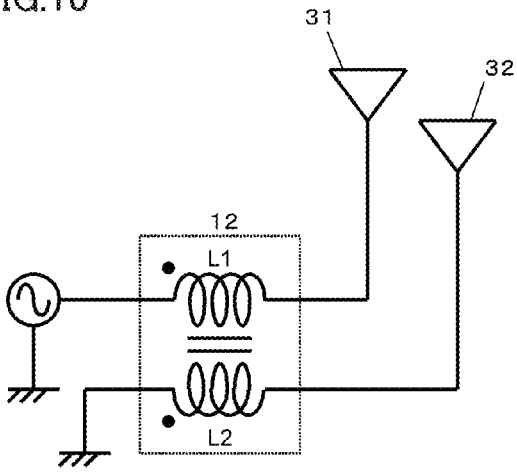
FIG. 10 is an equivalent circuit diagram of an antenna device according to a third preferred embodiment of the present invention.

As shown in FIG. 10, in the antenna device according to the present preferred embodiment, the first conductor and the second conductor, which define a radiation element, each have the other end as an open end. The first conductor is configured as a power feed radiation element (a first radiation element 31), and the second conductor is configured as a non-power feed radiation element (a second radiation element 32). The radiation element including the first radiation element and the second radiation element resonates in a plurality of resonance modes including an even mode and an odd mode. The first inductance element and the second inductance element defining a matching circuit are wound and connected such that the magnetic fields are mutually strengthened for one of the even mode and the odd mode, and that the magnetic fields are mutually weakened for the other of the even mode and the odd mode.

Other Preferred Embodiments

Although the present invention has been described with reference to specific preferred embodiments, the present invention is not limited to these preferred embodiments.

For example, the radiation element (antenna element) only has to be configured to include the first conductor having one end as a power feed end and the second conductor having one end as a ground end, and to resonate in a plurality of resonance modes including an even mode and an odd mode. In other words, the shapes of the power feed radiation element and the non-power feed radiation element are not limited to a simple monopole type, but may be various types of shapes such as a folded type and a T-branch type.

Furthermore, the radiation element is not limited to a pattern provided on a flexible substrate. For example, a chip antenna made of a dielectric element body having an antenna pattern provided thereon may be utilized, or a conductor pattern directly rendered on a printed wiring board or a terminal housing may be utilized.

Furthermore, the first inductance element and the second inductance element are not limited to a coiled element provided by winding a conductor pattern in a coil shape, but may be a magnetic coupling element which is categorized as a type based on magnetic-field coupling.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

an antenna including a first conductor including a power feed end and a second conductor including a ground end; and a matching circuit including a first inductance element loaded at the power feed end of the first conductor, and a second inductance element loaded at the ground end of the second conductor and magnetic-field coupled to the first inductance element; wherein the antenna is configured to resonate in a plurality of resonance modes including an even mode and an odd mode;

the first inductance element and the second inductance element are wound and connected such that magnetic fields are mutually strengthened for one of the even mode and the odd mode, and such that the magnetic fields are mutually weakened for the other of the even mode and the odd mode;

another end of the first conductor and another end of the second conductor are connected to one another, and the antenna defines a loop-shaped radiation element; and the first inductance element and the second inductance element are subtractive polarity coupled to each other.

2. The antenna device according to claim 1, wherein the antenna includes a first resonance mode, a second resonance mode and a third resonance mode in increasing order of a resonance frequency, the first resonance mode and the third resonance mode each are an odd mode, and the second resonance mode is an even mode.

3. The antenna device according to claim 1, wherein the first inductance element and the second inductance element are integrally provided with a stacked body including a plurality of base material layers stacked on each other.

4. The antenna device according to claim 1, wherein the antenna is one of a monopole type, a folded type, and a T-branch type.

5. The antenna device according to claim 1, wherein the antenna is defined by one of a conductive pattern on a flexible substrate, a chip antenna including an antenna pattern provided on a dielectric element body, a conductor pattern on a printed wiring board, and a conductor pattern on a terminal housing.

6. The antenna device according to claim 1, wherein the first inductance element and the second inductance element is one of a coiled element and a magnetic coupling element.

7. The antenna device according to claim 1, wherein the antenna device is configured to use 824 MHz to 960 MHz and 1710 MHz to 2170 MHz as a passband, and to accommodate a penta-band of GSM850, GSM900, GSM1800, GSM1900, and UMTS.

8. A communication apparatus comprising:

a power feed element;

an antenna including a first conductor including a power feed end and a second conductor including a ground end; and a matching circuit including a first inductance element loaded at the power feed end of the first conductor, and a second inductance element loaded at the ground end of the second conductor and magnetic-field coupled to the first inductance element; wherein the antenna is configured to resonate in a plurality of resonance modes including an even mode and an odd mode; and the first inductance element and the second inductance element are wound and connected such that magnetic fields are mutually strengthened for one of the even mode and the odd mode, and that the magnetic fields are mutually weakened for the other of the even mode and the odd mode;

another end of the first conductor and another end of the second conductor are connected to one another, and the antenna defines a loop-shaped radiation element; and the first inductance element and the second inductance element are subtractive polarity coupled to each other.

9. The communication apparatus according to claim 8, wherein the antenna includes a first resonance mode, a second resonance mode and a third resonance mode in increasing order of a resonance frequency, the first resonance mode and the third resonance mode each are an odd mode, and the second resonance mode is an even mode.

10. The communication apparatus according to claim 8, wherein the first inductance element and the second inductance element are integrally provided with a stacked body including a plurality of base material layers stacked on each other.

11. The communication apparatus according to claim 8, wherein the antenna is one of a monopole type, a folded type, and a T-branch type.

12. The communication apparatus according to claim 8, wherein the antenna is defined by one of a conductive pattern on a flexible substrate, a chip antenna including an antenna pattern provided on a dielectric element body, a conductor pattern on a printed wiring board, and a conductor pattern on a terminal housing.

13. The communication apparatus according to claim 8, wherein the first inductance element and the second inductance element is one of a coiled element and a magnetic coupling element.

14. The communication apparatus according to claim 8, wherein the communication apparatus is configured to use 824 MHz to 960 MHz and 1710 MHz to 2170 MHz as a passband, and to accommodate a penta-band of GSM850, GSM900, GSM1800, GSM1900, and UMTS.

* * * * *